US011303030B2

(12) United States Patent
Liu et al.

(10) Patent No.: US 11,303,030 B2
(45) Date of Patent: Apr. 12, 2022

(54) ANTENNA FOR AN ELECTRONIC DEVICE

(71) Applicant: Hewlett-Packard Development Company, L.P., Spring, TX (US)

(72) Inventors: Chun-Chih Liu, Taipei (TW); Ming-Shien Tsai, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 8 days.

(21) Appl. No.: 16/603,617

(22) PCT Filed: Apr. 13, 2017

(86) PCT No.: PCT/US2017/027387
§ 371 (c)(1),
(2) Date: Oct. 8, 2019

(87) PCT Pub. No.: WO2018/190842
PCT Pub. Date: Oct. 18, 2018

(65) Prior Publication Data

US 2020/0036097 A1 Jan. 30, 2020

(51) Int. Cl.
*H01Q 1/22* (2006.01)
*H01Q 9/04* (2006.01)
*H01Q 9/42* (2006.01)

(52) U.S. Cl.
CPC ..... *H01Q 9/0457* (2013.01); *H01Q 1/2266* (2013.01); *H01Q 9/42* (2013.01)

(58) Field of Classification Search
CPC ..... H01Q 9/0457; H01Q 1/2266; H01Q 9/42; H01Q 9/04; H01Q 1/2291
See application file for complete search history.

(56) References Cited

U.S. PATENT DOCUMENTS

| | | | | |
|---|---|---|---|---|
| 7,530,823 | B1 | 5/2009 | Thornton et al. | |
| 9,035,840 | B1 | 5/2015 | Lee | |
| 9,490,526 | B2 | 11/2016 | Rivera et al. | |
| 9,543,660 | B2 | 1/2017 | Rajagopalan et al. | |
| 9,559,433 | B2 | 1/2017 | Zhou et al. | |
| 2003/0129950 | A1* | 7/2003 | Kwak | H01Q 1/084 455/90.1 |
| 2006/0125700 | A1* | 6/2006 | Kanazawa | H01Q 1/243 343/702 |
| 2008/0300028 | A1* | 12/2008 | Uejima | H01Q 9/285 455/575.3 |
| 2009/0262029 | A1* | 10/2009 | Chiang | H01Q 1/2266 343/702 |

(Continued)

FOREIGN PATENT DOCUMENTS

| | | | |
|---|---|---|---|
| EP | 2237367 | A1 | 10/2010 |
| EP | 2876727 | A1 | 5/2015 |

(Continued)

OTHER PUBLICATIONS

Guterman, J. et al., Integration of Omnidirectional Wrapped Microstrip Antennas Into Laptops, 2006, < http://sci-hub.cc/10.1109/lawp.2006.873948 >.

*Primary Examiner* — David E Lotter
(74) *Attorney, Agent, or Firm* — HPI Patent Development

(57) ABSTRACT

An antenna for an electronic device is described. The antenna includes an antenna disposed in a first location and a signal conductor disposed in a second location. The antenna and the signal conductor are electrically coupled across an air gap.

13 Claims, 4 Drawing Sheets

(56) References Cited

U.S. PATENT DOCUMENTS

| | | | | |
|---|---|---|---|---|
| 2009/0316612 | A1* | 12/2009 | Poilasne | H01Q 1/38 370/297 |
| 2010/0328166 | A1 | 12/2010 | Ohguchi et al. | |
| 2011/0001674 | A1 | 1/2011 | Hikino | |
| 2011/0032161 | A1 | 2/2011 | Nakanishi et al. | |
| 2011/0109524 | A1* | 5/2011 | Saily | H01Q 21/08 343/893 |
| 2011/0298670 | A1 | 12/2011 | Jung et al. | |
| 2012/0306715 | A1 | 12/2012 | Montgomery et al. | |
| 2012/0327024 | A1* | 12/2012 | Veerasamy | H01L 51/002 345/174 |
| 2014/0111388 | A1 | 4/2014 | Di Nallo et al. | |
| 2016/0072539 | A1 | 3/2016 | Hu et al. | |
| 2017/0033460 | A1 | 2/2017 | Vazquez et al. | |
| 2017/0069954 | A1* | 3/2017 | Lui | H01Q 1/242 |
| 2017/0222301 | A1* | 8/2017 | Shiu | H01Q 1/2291 |
| 2019/0058240 | A1* | 2/2019 | Tang | H01Q 9/0407 |

FOREIGN PATENT DOCUMENTS

| | | | |
|---|---|---|---|
| JP | 2002217755 | A | 8/2002 |
| WO | WO-2007018146 | A1 | 2/2007 |

* cited by examiner

100

300

400

ANTENNA FOR AN ELECTRONIC DEVICE

BACKGROUND

Electronic devices may use radio waves to communicate with other electronic devices. An electronic device may include an antenna for transmitting and receiving radio waves. WiFi® and Bluetooth® are wireless technologies that facilitate the transmission and reception of radio waves by electronic devices.

DESCRIPTION OF THE DRAWINGS

Certain examples are described in the following detailed description and in reference to the drawings, in which.

DETAILED DESCRIPTION

Techniques for using an antenna in an electronic device are discussed herein. The antenna may be located in a top enclosure of the electronic device, while the signal conductor may be located in a bottom enclosure of the electronic device. The antenna and the signal conductor may be electrically coupled across an air gap.

An antenna is an electrical device that emits or receives radio waves. An antenna may be used with a transmitter. The transmitter generates a radio signal, which may be an alternating current. The antenna emits the radio signal as electromagnetic energy termed radio waves. An antenna may also be used with a receiver. The receiver is an electronic device that receives a radio signal from an antenna and converts the information carried by the radio signal into a usable form. Antennas, transmitters, and receivers may be essential components of equipment that utilizes radio. They may be included in many types of systems, including WiFi® computer networks and Bluetooth®-enabled devices. A radio system including both a transmitter and receiver may be termed a transceiver.

A signal conductor may conduct the AC current generated by the transmitter to an antenna. The signal conductor may also receive AC current from the antenna and transmit the AC current to a receiver. The transmitted signal and the received signal may cross the air gap that electrically couples the antenna and the signal conductor, for example, by capacitive coupling. The electrical coupling across an air gap of the techniques discussed herein may preclude the need for a physical connection.

Figure 1:
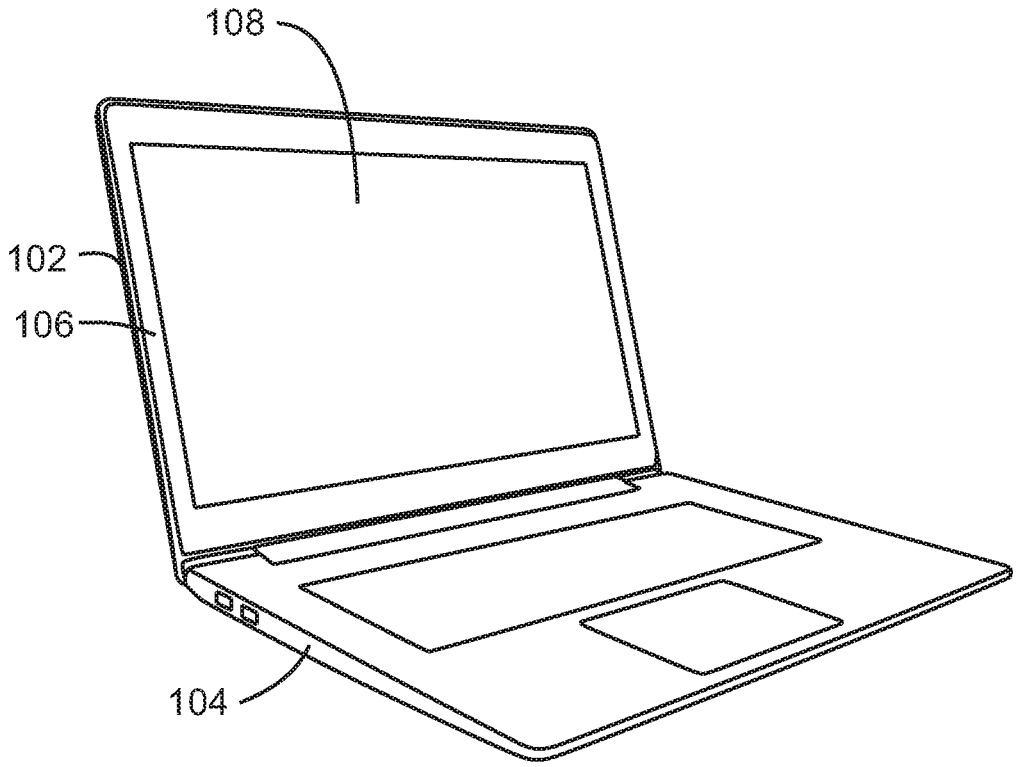
FIG. 1 is a diagram of an electronic device including an antenna in accordance with examples of the present techniques.

FIG. 1 is a diagram of an electronic device 100 including an antenna. The electronic device 100 may be a laptop computer or any electronic device having a top enclosure and a bottom enclosure connected together by a hinge. The electronic device 100 may include a top enclosure 102 and a bottom enclosure 104.

The top enclosure 102 of the electronic device 100 may include a bezel 106 and a panel glass 108. The bezel 106 may be the space between the display and the edge of a monitor of an electronic device, for example, covering the electronic circuits that power the display. A panel glass 108 is the glass that covers the front surface of the monitor. The panel glass 108 may extend to the bezel or cover the bezel.

The top enclosure 102 may contain an antenna. The antenna may be a windowless antenna. With a windowless antenna, there may be no cut-out area to accommodate a separate antenna. In this example, the metal case of the top enclosure 102, the bottom enclosure 104, or both, of the electronic device 100 may form part of the antenna.

The antenna may be located on an outer surface of the bezel 106, on an inner surface of the bezel 106, inside the bezel 106, on an outer surface of the panel glass 108, on an inner surface of the panel glass 108, or inside the panel glass 108, or combinations thereof. In some examples, the antenna may be a circuit board inside the bezel, or may be a transparent conductive coating printed on the bezel 106, or the panel glass 108, or both. In some examples, the transparent conductive coating may be indium tin oxide or partial silvering.

Figure 2A:
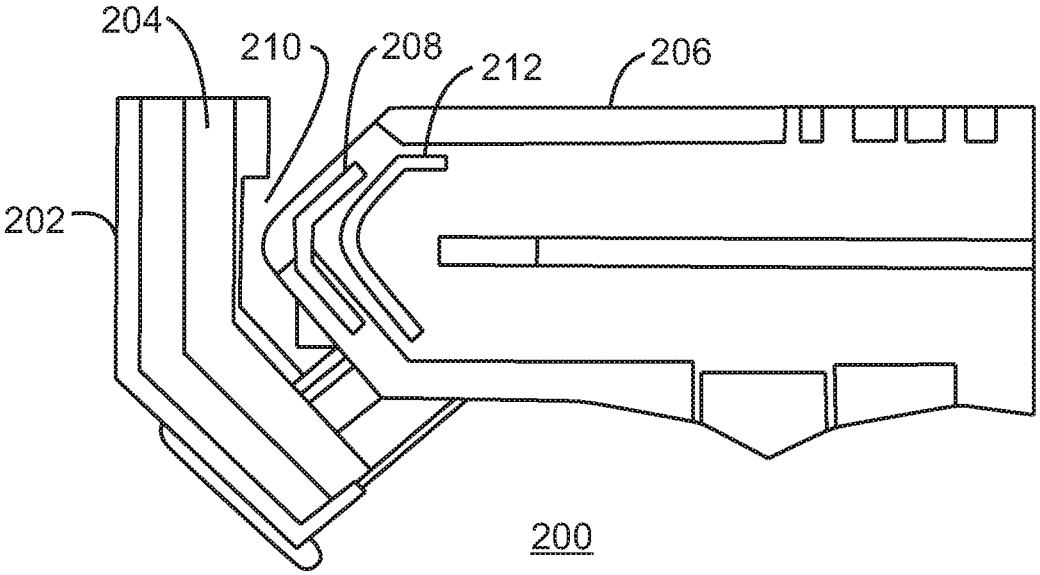
FIG. 2A is a cross-sectional diagram of an electronic device including an antenna in accordance with examples of the present techniques.

FIG. 2A is a cross-sectional diagram of an electronic device 200 including an antenna. The top enclosure 202 may include an antenna 204 and the bottom enclosure 206 may include a signal conductor 208. When the electronic device 200 is opened, the antenna 204, for example, in the top enclosure 202, and the signal conductor 208, for example, in the bottom enclosure 206, may be brought into proximity with each other, separated by an air gap 210. The air gap 210 is narrow enough that the antenna 204 and the signal conductor 208 may be electrically coupled across the air gap 210.

The signal conductor 208 may be a bent piece of metal, for example, in the back of the bottom enclosure 206. The signal conductor 208 forms a monopole. A monopole may be a single conductor mounted over a ground plane 212. The ground plane may be connected to electrical ground. The ground plane may be large compared to the wavelengths transmitted and received by the signal conductor 208.

The electrical coupling across the air gap 210 may be the result of capacitive coupling. Capacitive coupling is achieved by placing a capacitor between two nodes. For example, the antenna 204 and the signal conductor 208 may be the two nodes and the air gap 210 may be the capacitor. With capacitive coupling, low frequency wavelengths may be decreased in intensity or blocked by the coupling capacitor. Hence, the coupling capacitor, or air gap 210 in this example, may act as a high-pass filter. As many communications technologies, such as WiFi® and Bluetooth®, operate at higher frequencies, they may be effectively passed across the air gap. Accordingly, these techniques may be used in electronic devices employing the techniques described herein.

WiFi® is a communications technology for wireless local area networking. A wireless local area network (WLAN), formed using WiFi® connections, may be a wireless computer network that links two or more devices using a wireless distribution method within a limited area such as a home, school, computer laboratory, or office building. This may give users the ability to move around within a local coverage area and still be connected to the network. A WLAN may also provide a connection to the Internet.

WiFi® may use the 2.4 gigahertz (GHz) ultra high frequency (UHF) and 5 GHz super high frequency (SHF) industrial, scientific, and medical (ISM) radio bands. The very high frequency radio waves are associated with very high frequency electrical waves that may cross the air gap 210 described herein.

Bluetooth® is a wireless technology standard for exchanging data over short distances from fixed and mobile devices. Bluetooth® may use UHF radio waves in the ISM band from 2.4 to 2.485 GHz. As with WiFi®, the very high frequency radio waves are associated very high frequency electrical waves that may cross the air gap 210 described herein.

Figure 2B:
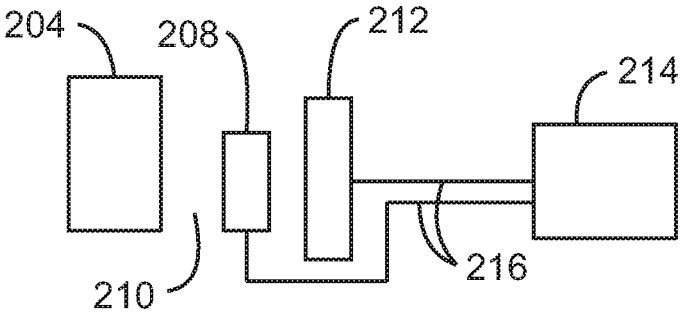
FIG. 2B is a block diagram showing the key components of an antenna in an electronic device in accordance with examples of the present techniques.

FIG. 2B is a block diagram showing the key components for using an antenna in an electronic device. The antenna 204 may be located in the top enclosure 202 of the electronic device 200. The antenna 204 may be any of the types of antenna described herein or located in any of the locations described herein. The bottom enclosure 206 of the electronic device 200 may contain the signal conductor 208. The antenna 204 may be electrically coupled to the signal conductor 208 across the air gap 210. The signal conductor 208 may be connected to an RF chip 214, for example, by a coaxial cable 216, or any other suitable type of connector. A coaxial able 216 is a type of cable that has an inner conductor surrounded by a tubular insulating layer, surrounded by a tubular conducting shield. Some coaxial cables 216 may have an insulating outer sheath or jacket. The term "coaxial" denotes that the inner conductor and the outer conductor share a geometric axis. The inner conductor may be coupled to the monopole 208. The outer, or ground, conductor may be connected to the ground plane 212. The RF chip 214 incorporates both a transmitter and a receiver.

Figure 3:
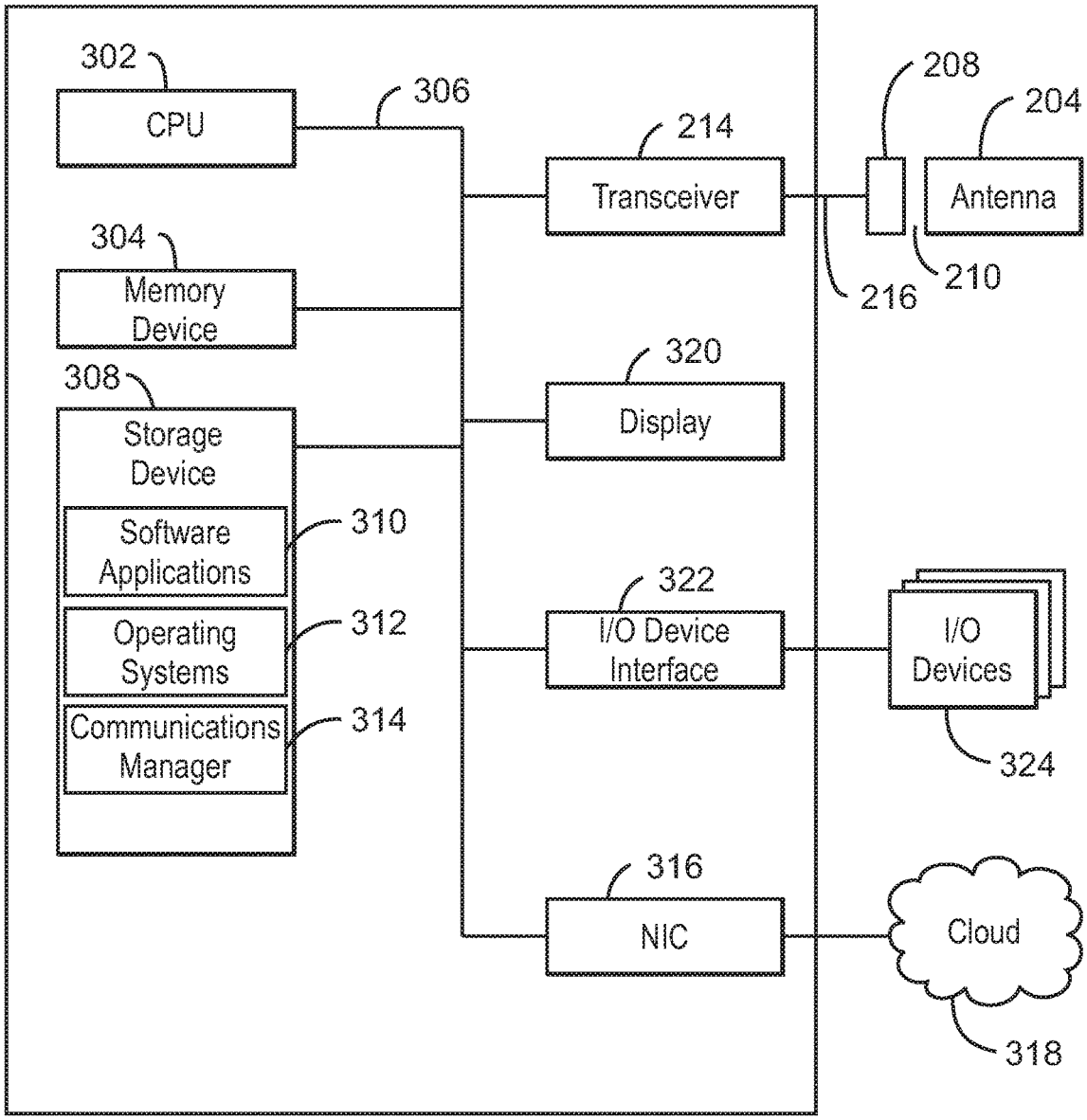
FIG. 3 is a block diagram of a system for using an antenna in an electronic device in accordance with examples of the present techniques.

FIG. 3 is a block diagram of a system 300 including an air gap between a monopole and an antenna in an electronic device. The system 300 may include a central processing unit (CPU) 302 for executing stored instructions. The CPU 302 may be more than one processor, and each processor may have more than one core. The CPU 302 may be a single core processor, a multi-core processor, a computing cluster, or other configurations. The CPU 302 may be a microprocessor, a processor emulated on programmable hardware, e.g., FPGA, or other types of hardware processor. The CPU 302 may be implemented as a complex instruction set computer (CISC) processor, a reduced instruction set computer (RISC) processor, an X86 instruction set compatible processor, or other microprocessor or processor.

The system 300 may include a memory device 304 that stores instructions that are executable by the CPU 302. The CPU 302 may be coupled to the memory device 304 by a bus 306. The memory device 304 may include random access memory (e.g., SRAM, DRAM, zero capacitor RAM, SONOS, eDRAM, EDO RAM, DDR RAM, RRAM, PRAM, etc.), read only memory (e.g., Mask ROM, PROM, EPROM, EEPROM, etc.), flash memory, or any other suitable memory system. The memory device 304 can be used to store data and computer-readable instructions that, when executed by the processor 302, direct the processor 302 to perform various operations in accordance with embodiments described herein.

The system 300 may also include a storage device 308. The storage device 308 may be a physical memory device such as a hard drive, an optical drive, a flash drive, an array of drives, or any combinations thereof. The storage device 308 may store data as well as programming code such as software applications 310, operating systems 312, and the like. The programming code stored by the storage device 308 may be executed by the CPU 302.

The storage device 308 may include a communications manager 314. The communications manager 314 may coordinate the transmitting and receiving of communications by the electronic device 300. For example, the communications manager 314 may oversee the functioning of a transceiver 214. The transceiver 214 may include a transmitter and receiver that share common circuitry.

The transceiver 214 may be connected to a signal conductor 208 by a cable 216. The signal conductor 208 may be electrically coupled to an antenna 204 across an air gap 210. The electrical signals cross both ways across the air gap 210. For example, the electrical signals cross from the signal conductor 208 to the antenna 204 when the transceiver 214 is transmitting or from the antenna 204 to the signal conductor 208 when the transceiver 214 is receiving. As discussed herein, the high frequency of the electrical signals involved may facilitate crossing of the air gap 216. The system 300 may further include a network interface controller (NIC) 316 to provide a wired connection to the cloud 318.

The system 300 may also include a display 320. The display 320 may be a touchscreen built into the device. Alternatively, the display 320 may be an interface that couples to an external display.

The system 300 may include an input/output (I/O) device interface 322 to connect the system 300 to one or more I/O devices 324. For example, the I/O devices 324 may include a scanner, a keyboard, and a pointing device such as a mouse, a touchpad, or touchscreen, among others. The I/O devices 324 may be built-in components of the system 300, or may be devices that are externally connected to the system 300.

Figure 4:
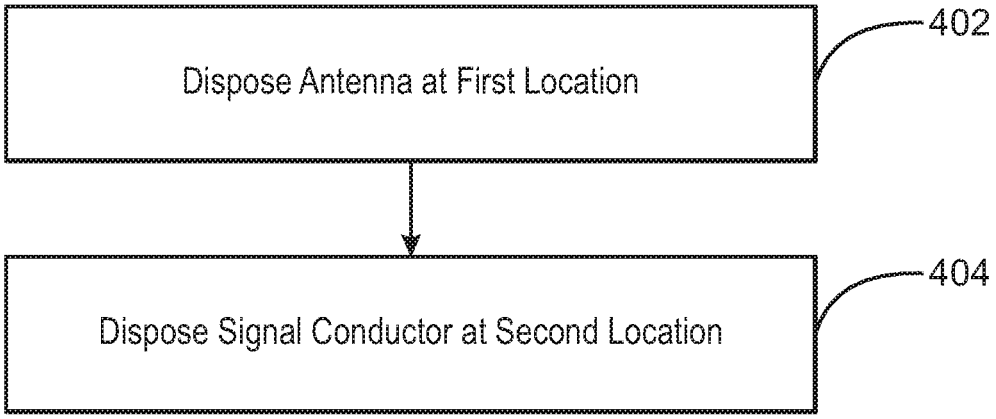
FIG. 4 is a process flow diagram of a method for manufacturing an antenna for use in an electronic device in accordance with examples of the present techniques.

FIG. 4 is a process flow diagram of a method 400 for manufacturing an antenna for use in an electronic device. The method 400 may start at block 402 when the antenna is disposed at a first location. For example, the antenna may be disposed in the top enclosure of an electronic device. The antenna may be located on an outer surface of the bezel, on an inner surface of the bezel, inside the bezel, on an outer surface of the panel glass, on an inner surface of the panel glass, or inside the panel glass, or combinations thereof. Alternatively, the antenna may be a circuit board or transparent conductive coating printed on the bezel, or the panel glass, or both.

At block 404, a signal conductor may be disposed at a second location. For example, the signal conductor may be disposed in the bottom enclosure of the electronic device. The first location and the second location are separated by an air gap that an electrical signal may cross. The method 400 may include any number of additional blocks not shown in FIG. 4, depending on the details of the specific implementation.

While the present techniques may be susceptible to various modifications and alternative forms, the examples discussed above have been shown only by way of example. It is to be understood that the techniques are not intended to be limited to the particular examples disclosed herein. Indeed, the present techniques include all alternatives, modifications, and equivalents falling within the scope of the present techniques.

What is claimed is:

1. An electronic device, comprising:

an antenna disposed in a first location; and a signal conductor disposed in a second location, wherein, responsive to being opened, the electronic device is to bring the antenna closer to the signal conductor such that an air gap is formed between the antenna and the signal conductor, the air gap sufficiently narrow so as to allow the antenna and the signal conductor to electrically couple to each other across the air gap, and wherein, responsive to being transitioned towards closed, the electronic device is to reduce the air gap.

2. The electronic device of claim 1, wherein a top enclosure of the electronic device comprises a bezel, and wherein the antenna is disposed on an outer surface of the bezel, an inner surface of the bezel, or inside the bezel, or combinations thereof.

3. The electronic device of claim 1, wherein a top enclosure of the electronic device comprises a panel glass, and wherein the antenna is disposed on an outer surface of the panel glass, an inner surface of the panel glass, or inside the panel glass, or combinations thereof.

4. The electronic device of claim 1, wherein the antenna comprises a windowless antenna.

5. The electronic device of claim 4, wherein the windowless antenna comprises a circuit board or transparent conductive coating printed on the bezel of the electronic device, or the panel glass of the electronic device, or both.

6. The electronic device of claim 5, wherein the transparent conductive coating comprises indium tin oxide, or partial silvering, or both.

7. The electronic device of claim 1, wherein the signal conductor is disposed in a bottom enclosure of the electronic device, and wherein the signal conductor comprises a bent piece of metal forming a monopole.

8. A method of manufacturing an antenna for an electronic device, comprising:

disposing the antenna in a first enclosure of the electronic device;

disposing a signal conductor in a second enclosure of the electronic device; and coupling the first and second enclosures together such that, responsive to an opening of the electronic device, an air gap is formed that is sufficiently narrow so as to allow the antenna and the signal conductor to electrically couple to each other across the air gap and such that, responsive to transitioning towards a closing of the electronic device, the air gap is reduced.

9. The method of claim 8, comprising disposing the antenna on an outer surface of a bezel of the electronic device, an inner surface of the bezel, or inside the bezel, or combinations thereof.

10. The method of claim 8, comprising disposing the antenna on an outer surface of a panel glass of the electronic device, an inner surface of the panel glass, or inside the panel glass, or combinations thereof.

11. The method of claim 8, comprising printing a circuit board or a transparent conductive coating on a bezel of the electronic device, a panel glass of the electronic device, or both.

12. The method of claim 11, wherein the transparent conductive coating comprises indium tin oxide, partial silvering, or both.

13. The method of claim 8, comprising forming the signal conductor by bending a piece of metal to form a monopole.

* * * * *